United States Patent [19]

Geller

[11] Patent Number: 4,739,943

[45] Date of Patent: Apr. 26, 1988

[54] PROTECTIVE COVER FOR TOILET PAPER ROLL

[76] Inventor: Dan Geller, 912 Powell St., Ste. 5, San Francisco, Calif. 94111

[21] Appl. No.: 94,276

[22] Filed: Sep. 8, 1987

Related U.S. Application Data

[63] Continuation-in-part of Ser. No. 932,450, Jan. 5, 1987, abandoned, which is a continuation-in-part of Ser. No. 877,481, Jun. 23, 1986, abandoned.

[51] Int. Cl.[4] ..... B65H 19/00; B65D 85/66

[52] U.S. Cl. ..... 242/55.2; D6/523; 206/389

[58] Field of Search ..... 242/55.2, 55.53; 206/390, 389, 409, 395, 396, 400; 150/52 D, 52 R

[56] References Cited

U.S. PATENT DOCUMENTS

| | | | |
|---|---|---|---|
| 4,467,974 | 8/1984 | Crim | 242/55.53 |
| 4,549,689 | 10/1985 | Bailey | 242/55.53 X |
| 4,645,108 | 2/1987 | Gavin et al. | 206/390 X |

*Primary Examiner*—Stuart S. Levy
*Assistant Examiner*—Steven du Bois

[57] ABSTRACT

This invention provides a cover comprising a flat plate fabricated from a flexible plastics material and having a retangular configuration. A first end of the plate is formed into locking means for releasably engaging the second end of the plate for holding the plate in a cylindrical shape encircling the roll.

13 Claims, 3 Drawing Sheets

PROTECTIVE COVER FOR TOILET PAPER ROLL

This is a continuation-in-part of U.S. application Ser. No. 932,450 filed Jan. 5, 1987, which in turn is a continuation-in-part of U.S. application Ser. No. 877,481 filed June 23, 1986, both now abandoned.

SUMMARY OF THE INVENTION

This invention relates in general to bathroom accessories, and more particularly relates to a protective cover for use with toilet paper rolls mounted within dispensers in a bathroom or toilet facility.

Toilet paper dispensers are commonly employed in homes and institutions such as in bathrooms and toilet facilities of motels, hotels, schools, offices and the like. These dispensers mount the toilet paper rolls on different types of brackets or holders, such as on the wall adjacent the toilet. Typically the paper rolls are exposed such that they can easily become soiled, dusty or wet. In operations such as hotels and motels where the rooms have a high turnover rate, it is desirable for sanitary purposes as well as aesthetics to have fresh toilet paper available for each guest. In such case, paper that becomes soiled or wetted must be discarded and replaced which results in increased costs. The need has been recognized for a simple and inexpensive arrangement for protecting toilet paper rolls when installed in paper dispensers while maintaining an attractive appearance.

Accordingly, it is an object of the present invention to provide a new and improved cover for protecting a roll of toilet paper from becoming soiled or wetted when installed in a paper dispenser.

Another object is to provide a cover of the type described which is inexpensive to fabricate, which can be easily mounted and dismounted about the paper roll, which is aesthetically appealing when mounted about the roll and which is adapted to carry instructional or promotional indicia or decorative designs and graphics.

Another object is to provide a protective cover of the type described which includes means applying a continuous drag force against the paper roll resisting unintentional unrolling of the paper whereby excessive paper waste is avoided.

The invention in summary provides a cover comprising a flat plate fabricated from a flexible plastics material and having a rectangular configuration. A first end of the plate is formed into locking means for releasably engaging the second end of the plate for holding the plate in a cylindrical shape encircling the roll.

The foregoing and other objects and features of the invention will become apparent from the following specification taken in conjunction with the accompanying drawings.

BRIEF DESCRIPTION OF THE PREFERRED EMBODIMENTS

Figure 1:
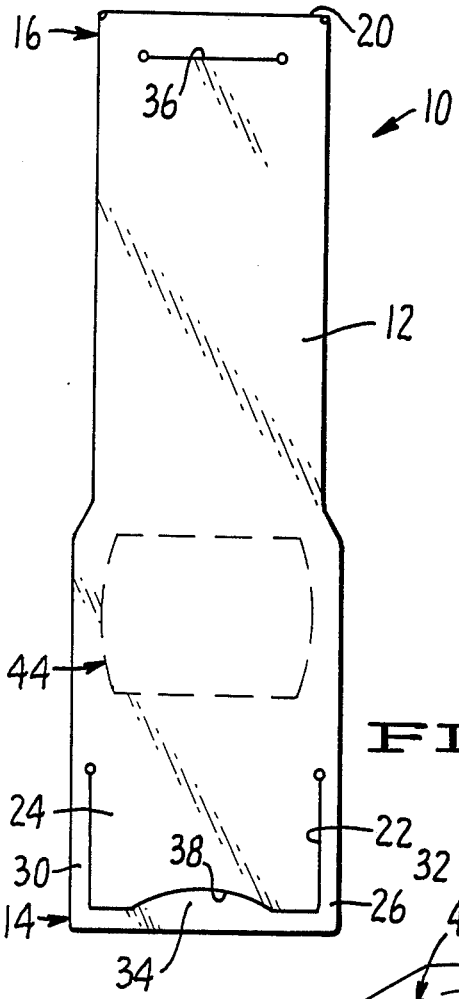
FIG. 1 of the drawing is a plan view of the protective cover according to one embodiment of the invention shown in flat configuration.
Figure 3:
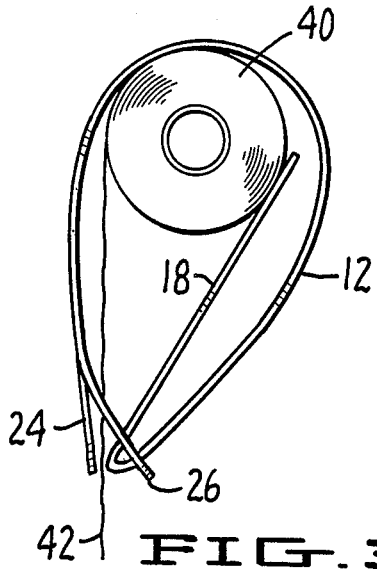
FIG. 3 is a side elevational view of the cover of FIG. 1 shown in a cylindrical configuration mounted about a typical roll of toilet paper.

In the drawings, FIGS. 1–4 illustrate generally at 10 a protective cover according to one preferred embodiment of the invention. Cover 10 is comprised of a flat plate 12 fabricated from a flexible material which permits the plate to be bent or rolled into a cylindrical configuration. The plate is rectangular with a length along the long axis sufficient to encircle a roll of toilet paper with extra space about the roll as illustrated in FIG. 3.

The plastics material employed for plate 12 provides a degree of stiffness for proper operation in a manner to be described, is water- and stain-resistant and is adapted to be printed with instructional or promotional indicia or with decorative graphics. Among the synthetic plastics materials suitable for use to form the plate in this invention are polyethylene or polyvinyl chloride (PVC). Flexibility of the cover is also a function of material thickness, and a plate thickness in the range of 0.010″ to 0.020″, and preferably 0.015″, is suitable where the material employed is PVC.

Plate 12 can be die cut from a sheet of the plastics material into a generally rectangular configuration having a long axis on the order of 17½″ extending from a first end 14 to a second end 16. An integral extension of the second end forms a pressure leaf 18 which is folded back at bight portion 20 and extends for a distance of approximately 5″ at a predetermined included angle, preferably on the order of 25° with respect to the plate.

Figure 2:
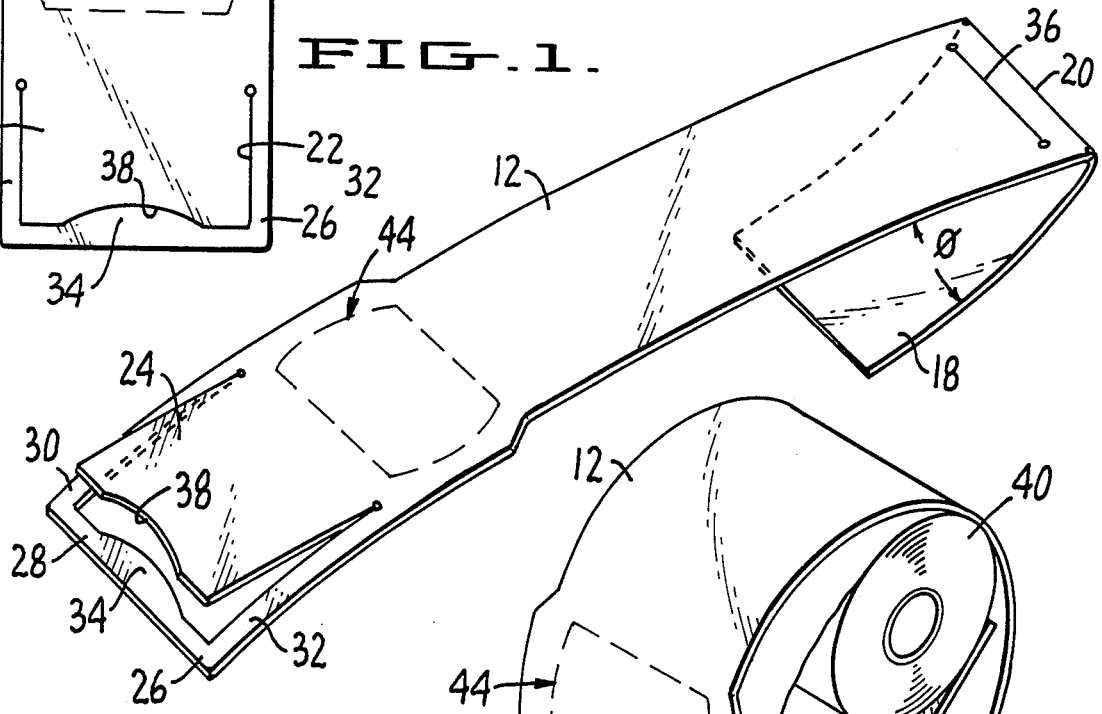
FIG. 2 is a perspective view of the cover of FIG. 1.
Figure 4:
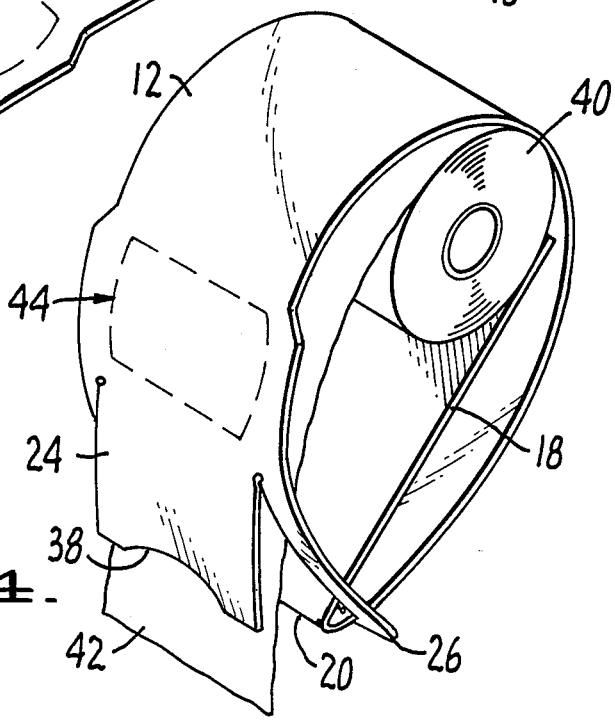
FIG. 4 is a perspective view of the cover of FIG. 3 in the cylindrical configuration.

A U-shaped slot 22 is cut about the outer margin of the first end. The plate portion enclosed by the slot defines a protective flap 24, and the plate portion surrounding the slot defines a U-shaped locking arm 26. The locking arm is comprised of a transverse rib 28 carried by a pair of laterally spaced fingers 30,32. The first end of the plate has a width on the order of 5″, suitable for use with paper rolls of standard length, and this width extends to approximately the mid-span of the plate where it narrows to a width of 4½″ which continues along the second end. The lateral spacing of the fingers of the arm is commensurate with the width of the second end such that the second end and pressure leaf are insertable between the fingers when the plate is rolled into a cylindrical configuration as shown in FIGS. 2–3.

Means is provided for releasably engaging the locking arm with the second end of the plate for holding the plate in the cylindrical configuration. The releasable engaging means includes an intrusive locking tab 34 formed on transverse rib 28 together with a matching slot 36 formed transversely along the base of bight portion 20 at the second end. The locking tab has an inwardly convex shape which is sized to fit into a cutout 38 formed in the distal end of protective flap 24. When the plate is bent into the cylindrical shape, locking arm 26 is fitted about the second end and leaf 18 so that the locking tab 34 can be manually inserted into locking slot 36. As the plate is rolled into this shape, the elastic memory of the plastics material exerts a restoring force tending to return the plate to its flat configuration. This restoring force acts through the locking arm to maintain interengagement of the tab and slot.

With the plate bent and releasably locked in its cylindrical configuration and mounted about a paper roll 40, protective flat 24 hangs downwardly by gravity. The free end 42 of the paper being dispensed from the roll extends along and is guided by the inside surface of the flap. The edge of the paper is visible through cutout 38 of the flat which provides space for a person's fingers to grasp the paper. The distal end of the flap provides a cutting edge against which the paper can be drawn to tear it from the roll.

Pressure leaf 18 is bent inwardly from the plate after being cut from the stock by the die, and the plastics material at bight portion 20 is deformed beyond its yield point so that the leaf is set at the predetermined angle $\phi$ with respect to the plate. When the plate is bent into the cylindrical configuration, leaf 18 projects upwardly with its distal end in contact with the outer surface of roll 40 which is carried on a conventional spindle, not shown. The distal end of the leaf is resiliently urged against the roll by the force of elastic memory of the plastics material. Additional pressure force is applied on the leaf by the edge of locking tab 34 which extends through slot 36 and is urged against the base of the leaf by the force being applied through locking arm 26 due to the elastic memory tending to straighten out the plate. The force applied by the locking tab causes leaf 18 to act as a lever and maintain continual contact of its distal end against the paper when the roll diameter decreases as paper is progressively dispensed. This contact by the end of the leaf against the paper creates a drag force which tends to resist unrolling of the paper, thereby preventing excess paper from being unintentially pulled from the roll. The drag of the leaf also makes it easier for a person to tear off the paper in that the resistance force tends to hold the roll as the paper is drawn across the cutting edge of the flap.

Figure 5:
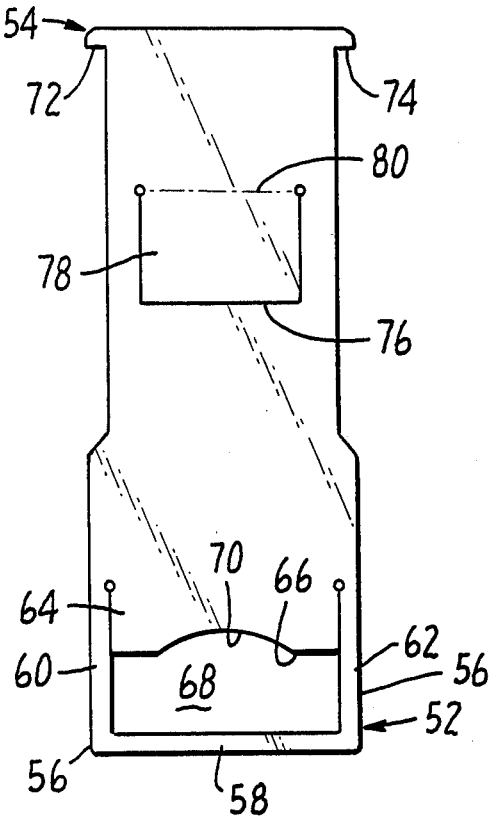
FIG. 5 is a plan view of a protective cover according to another embodiment of the invention.
Figure 6:
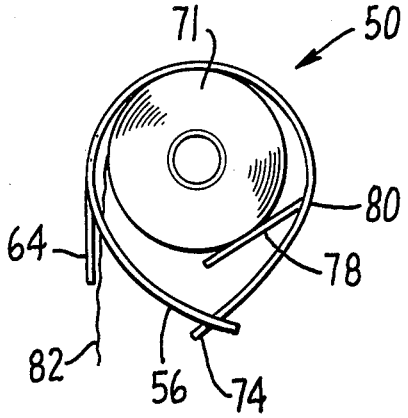
FIG. 6 is a side elevational view of the cover of FIG. 5 shown in a cylindrical configuration mounted about a typical roll of toilet paper.

Another embodiment of the invention illustrated in FIGS. 5–6 provides a protective cover 50. Cover 50 is comprised of a flat plate 52 fabricated from a suitable flexible material permitting it to be bent or rolled into a cylindrical configuration. Polyethylene or polyvinyl chloride are examples of synthetic plastics materials suitable for this purpose. The plate thickness is in the range of 0.010" to 0.020", and preferably 0.015".

In this embodiment, plate 50 is cut into a generally rectangular configuration having its long axis of a length on the order of 16¼ extending from a first end 52 to a second end 54. The first end has a width on the order of 5" and this width extends to approximately the midspan where it narrows to a width of 4½ which continues along the second end.

First end 52 is formed about its outer margin into a U-shaped locking arm 56 comprised of a transverse rib 58 carried by a pair of fingers 60,62. The fingers are laterally spaced apart commensurate with the width of the second end so that the fingers snugly fit about the end in a manner to be presently described.

The sheet of stock plastics material is cut to form a protective flap 64 having its proximal end integral with the plate with its distal end 66 projecting for a length on the order of 1½" toward the transverse rib. This leaves an opening 68 between the distal end of the flap and the inner edge of the rib. An arcuate cutout 70 is formed in the distal end of the flap to provide space for a person's fingers to grasp the free end of the paper extending from paper roll 71.

Figure 7:
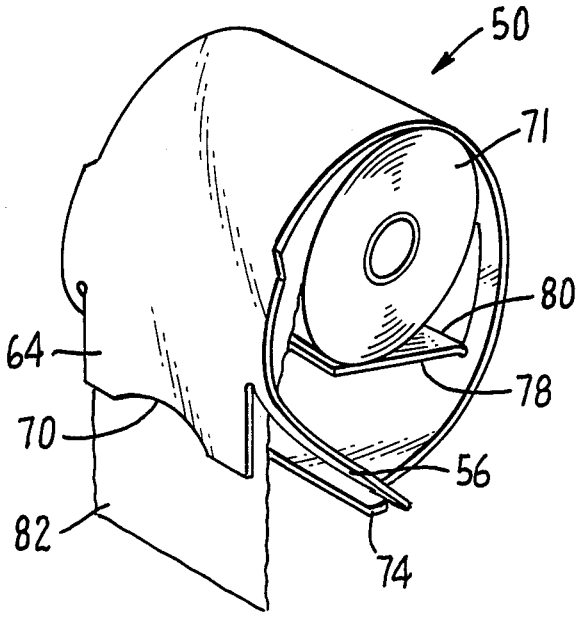
FIG. 7 is a perspective view of the cover of FIG. 5 shown in the cylindrical configuration.
Figure 8:
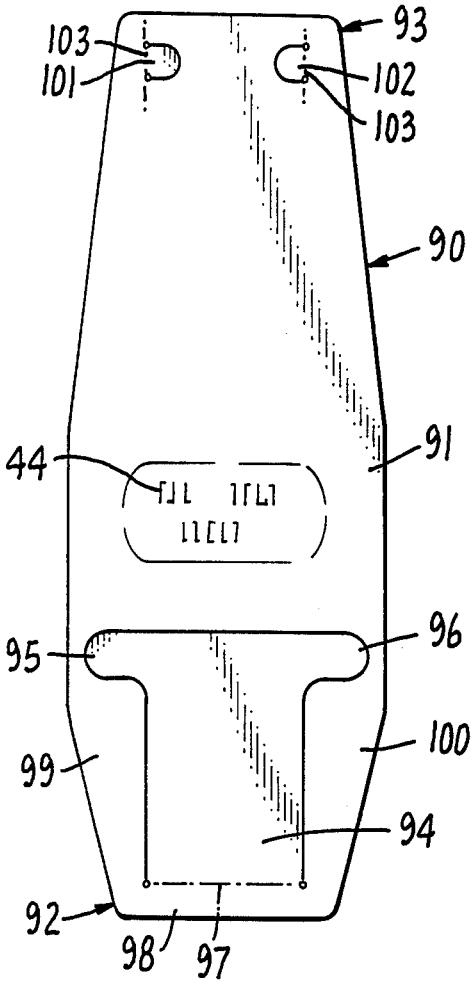
FIG. 8 is a plan view of a protective cover according to a third embodiment of the invention.

Means for releasably engaging locking arm 56 with second end 54 of the plate includes a pair of outwarding projecting tabs 72, 74 formed on opposite sides of the second end. When the plate is bent into the cylindrical shape as illustrated in FIGS. 6–7, the locking arm is sprung apart sufficient to be moved over the tabs. As the plate is released, its elastic memory exerts a restoring force tending to return the plate to a flat configuration. This force acts through the fingers of the locking arm which pull the transverse rib into locking engagement with the tabs.

A U-shaped cut 76 is made in the plate near its second end to form a pressure leaf 78 having a distal end extending toward the midspan of the plate. The pressure leaf is then bent inwardly so that the plastics material at the bight portion 80 is deformed beyond its yield point to set the leaf at an obtuse angle on the order of 150° with respect to the plate when the roll is full size. With the plate bent into the cylindrical configuration about the roll in the manner illustrated in FIGS. 6–7, the leaf thereby projects downwardly with its distal end in contact with the outer surface of the roll. The leaf's distal end is resiliently urged against the roll by the force of elastic memory to create a drag force which resists unrolling of the paper.

The upward pressure from the leaf also tends to elevate the roll on the spindle. Bight portion 80 of the pressure leaf is relatively closer to the roll in comparison to the embodiment of FIGS. 1–4, and thereby the pressure leaf of this embodiment continues to apply a relatively greater force when the roll diameter decreases as paper is dispensed. As paper is dispensed, the angle of the pressure leaf gradually changes from the 150° initial angle to approximately 90°, depending on the size of the roll.

With cover 50 mounted about the paper roll in the manner illustrated in FIGS. 6 and 7, distal end 66 of protective flap 64 projects downwardly a relatively shorter distance in comparison to the protective flap 24 of the embodiment of FIGS. 1–4. This configuration makes the flap relatively more stiff, thereby making it easier for a person to tear off the squares of paper from the free end 82 of paper extending downwardly from the roll. Additionally, the shorter length of the flap facilitates access through opening 68 between the locking arm, thereby making it easier for a person to grasp paper on the inside.

Figure 9:
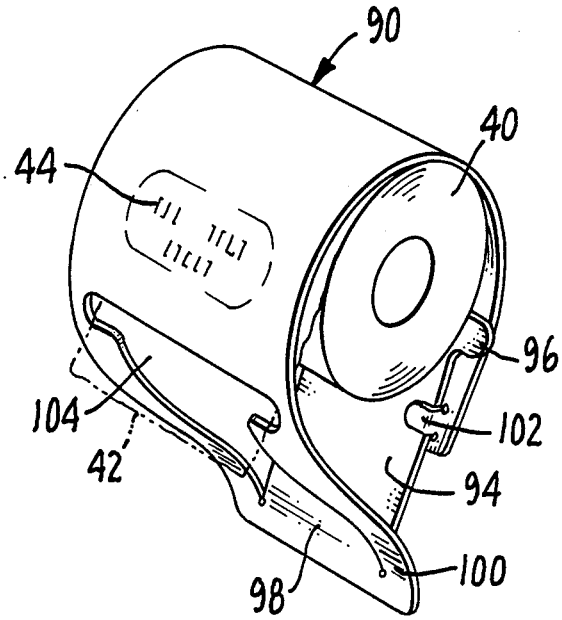
FIG. 9 is a perspective view of the cover of FIG. 8 in the cylindrical configuration.
Figure 10:
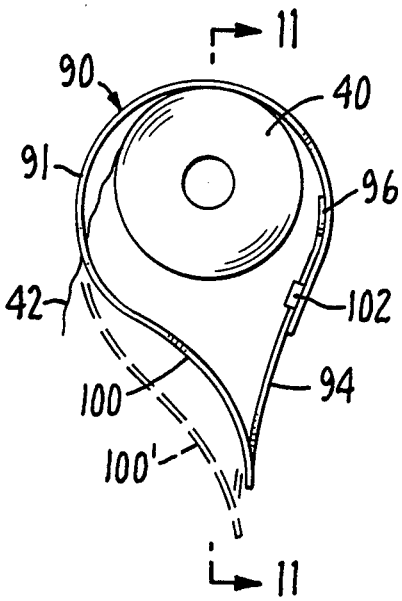
FIG. 10 is a side elevational of a cover of FIG. 8 shown in a cylindrical configuration mounted about a typical roll of toilet paper.

A third embodiment of the invention is illustrated in FIGS. 8–11. Here again, the protective cover 90 is formed from a flat plate 91 fabricated from flexible material that may be bent or rolled into a cylindrical configuration as shown in FIGS. 9 and 10. The flat plate 91 is cut into a generally rectangular configuration in the order of 14" in length extending from a first end 92 to a second end 93 disposed on the long axis. The flat plate tapers from a maximum width of about 5" near its middle toward each of the ends which are roughly 3½ in width.

A locking flap 94 is die cut at the first end 92 and is hinged as at 97 along a transverse rib 98 along the first end 92. The transverse rib is carried by a pair of fingers 99,100. The locking flap 94 has a pair of locking flap tabs 95,96 at its non-hinged end. When the plate is rolled into a cylindrical configuration, the locking flap 94 slides between and beneath a pair of hinged retention flaps 101,102 cut near the second end 93 of the plate 91. These retention flaps 101,102 hinge as at 103 and are spaced so that they receive the sides of the locking flap 94 between and beneath them as shown more clearly in FIGS. 9 and 11. The flap tabs 95,96 interfere with the retention flaps 101,102, respectively, and prevent the locking flap 94 from sliding out from its interlocked position with the retention flaps 101,102 when the cover is curled into its generally cylindrical shape shown in FIGS. 9 and 10 around a roll of toilet tissue 40.

Figure 11:
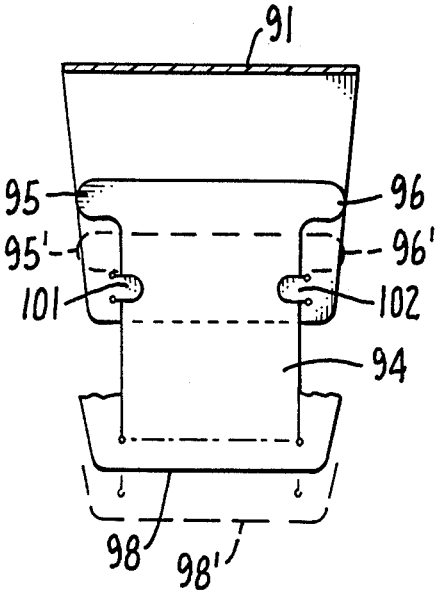
FIG. 11 is a detailed sectional view of the locking structure in locking engagement taken along line 11—11 of FIG. 10.

The locking flap 94 in this configuration bends along hinge 97, leaving opening 104 through which the end 42 of the toilet tissue depends as shown in FIGS. 9 and 10. The edges of the locking flap 94 slidably engage each of the retention flaps 101, 102 so that the protective cover can be reduced manually in diameter to fit tightly around the tissue roll as the roll is consumed for example as is shown in FIGS. 10 and 11 for flap tabs 95', 96' and 95, 96, respectively, and transverse rib 98'98 and finger 100'100. This tight fit around the tissue roll applies a drag force on the roll to resist unrolling.

The outer surface of the plate may carry indicia 44 providing advertising or promotional messages as well as a trademark or logo-type of the hotel, motel or other institution.

The use and operation of the invention will be explained for the embodiment of FIGS. 1–4. Cover 10 is installed by using either of two methods. The first is to mount flexible plate 12 about a fresh paper roll which is then mounted in the toilet paper dispenser. The second method is to install the plate about a paper roll which is already mounted in a dispenser. The plate is bent around the roll into the shape of a cylinder with the second end 16 and leaf 18 inserted between the fingers of arm 26 so that locking tab 34 is aligned with and inserted into slot 36. The elastic memory of the plate pulls the tab into full engagement through the slot and also into contact with the base of leaf 18. The tab applies force against the leaf causing its distal end to bear against the outer surface of the roll and create the drag force which resists unrolling of the paper. As paper is used up, the lever action of the leaf maintains this pressure by automatically adjusting to a decrease in roll diameter. Cover 10 can be quickly dismounted for replacing a fresh roll in the dispenser by manually pulling arm 26 away until tab 34 disengages from the slot, and then permitting the plate to unroll back to the flat configuration.

The embodiment shown in FIGS. 8–11 by means of the slidable locking tab and retention flaps permits one to reduce the diameter of the protective cover manually as the tissue roll is used in order to maintain it tightly around the roll so that in this embodiment the pressure leaf is not needed.

With the cover installed, the plate protects the paper of the roll from soiling and wetness. This not only maintains the roll in a sanitary condition but also improves its aesthetic appearance. In addition, a user need only touch the part of the paper to be used because only the paper extending along or below the distal end of flap 24 need be handled to pull out and tear off a length of paper. The cover thereby protects the remaining part of the roll from being touched by the user. These features result in a reduction in paper waste. Normally many hotels and motels replace the toilet paper rolls when the roll size is reduced to one-half size, or in some cases to only three-fourths size, because the rolls either become wet or soiled or because of the desire to maintain a fresh appearance of the roll for the next guest. Use of the cover of the present invention minimizes the requirement to replace the rolls with the result that more of the paper in a roll can be used before replacement. The plastics material of the cover is also relatively durable and smooth so that it can be easily cleaned for extended usage.

In hotel and motel operations, it is common for the maid when making up the room for the next guest to carefully fold the free end of the paper roll for aesthetic appearance and to create the impression that a fresh roll of paper is available. With the cover of the present invention, a clean aesthetic appearance can be maintained without the need to fold the end of the paper, thereby resulting in saving the time and labor which would otherwise be required when making up the room.

Cover 10 also affords a means of providing instructional, promotional or graphics displays. Thus, the inner surface of protective flap 24, which would be facing away from the user after installation, could carry printed instructions for installing the cover. The outer surface of the plate and flap could also be printed with indicia 44 providing advertising or promotional messages as well as the trademark or logotype of the hotel, motel or other institution. To match a particular decor of the bathroom, such as for use in private homes, the cover plates could be made of materials of different colors. The outer surface of the plate could also be printed with designs or graphics to match the bathroom decor. The covers could also be used to promote the sale of toilet paper by including one or more of the decorated covers as free premiums when a package of toilet paper rolls is purchased by the consumer.

Cover 10 is relatively simple and inexpensive to manufacture in that it can be die cut as one piece from flat stock of the plastics material. No parts are required to be assembled. After the die cutting operation, it is only necessary to apply any desired printing or graphics and then bend pressure leaf 18 to the required angle. It is easy to stack a number of the covers for compact storage, as for example on a room maid's cart or housekeeping storeroom. The compactness also permits the covers to be inexpensively shipped.

While the foregoing embodiments are at present considered to be preferred, it will be understood that numerous variations and modifications may be made therein by those skilled in the art and it is intended to cover in the appended claims all such variations and modifications as fall within the true spirit and scope of the invention.

What is claimed is:

1. A cover for use with a roll of toilet paper, the cover comprising a flat plate formed of a flexible material and having a rectangular configuration with first and second ends disposed on the long axis, said first end being formed about its outer margin into a U-shaped locking arm, a protective flap enclosed by the locking arm, said locking arm comprising a transverse rib carried by a pair of fingers, said fingers being laterally spaced apart commensurate with the width of the second end of the plate for receiving paper therebetween when the plate is curved in a cylindrical configuration for encircling the roll, means for releasably engaging the locking arm with the second end of the plate with the fingers enclosing the second end when the latter is in the circular configuration said plate including means for applying a drag force on the paper resisting unrolling motion thereof.

2. A cover as in claim 1 in which the means on said plate for applying a drag force on the paper includes a pressure leaf carried on the second end, said leaf portion extending inwardly when the plate is in the cylindrical shape into contact with the paper roll.

3. A cover as in claim 2 in which the distal end of the pressure leaf extends upwardly when the plate is encircling the roll.

4. A cover as in claim 2 in which the distal end of the pressure leaf extends downwardly when the plate is encircling the roll.

5. A cover as in claim 1 in which the means for releasably engaging the locking arm comprises a locking tab carried on the transverse rib and means forming a slot on the second end, said tab extending through the slot when the plate is in the cylindrical configuration with the straightening force of elastic memory of the plate material urging the tab into the slot.

6. A cover as in claim 5 in which the plate includes a pressure leaf carried on the second end, said pressure leaf extending inwardly when the plate is in the cylindrical shape into contact with the paper roll for applying a drag force on the paper resisting unrolling motion thereof, said tab being sized to contact a portion of the leaf when the tab is inserted in the slot, said tab applying leverage force against the leaf urging the leaf inwardly against the roll to apply the drag force.

7. A cover for use with a roll of toilet paper, the cover comprising a flat plate formed of a flexible material and having a rectangular configuration with first and second ends disposed on the long axis, means forming a U-shaped slot about the outer margin of the first end, the plate portion enclosed by the slot defining a protective flap and the plate portion surrounding the slot defining a U-shaped locking arm comprising a transverse rib carried by a pair of fingers, said fingers being laterally spaced apart commensurate with the width of the second end of the plate for receiving paper therebetween when the plate is curved in a cylindrical configuration for encircling the roll, means for releasably engaging the locking arm with the second end of the plate when the latter is in the circular configuration said plate including means for applying a drag force on the paper resisting unrolling motion thereof.

8. A cover as in claim 7 in which the leaf portion extends at an included angle of substantially 25° with respect to the second end of the plate.

9. A cover for use with a roll of toilet paper, the cover comprising a flat plate formed of a flexible material and having a generally rectangular configuration with first and second ends disposed on the long axis, said first end carrying locking means associated with a transverse rib formed by said first end and carried by a pair of spaced apart fingers, and said second end carrying means releasably engageable with the locking means to hold the plate in a cylindrical configuration encircling the roll of toilet paper.

10. A cover as in claim 9 carrying indicia on its outer surface when in said cylindrical configuration.

11. A cover for use with a roll of toilet paper, the cover comprising a flat plate formed of a flexible material and having a generally rectangular configuration with first and second ends disposed on the long axis, said first end carrying a locking flap bendable upon a hinge defined along a transverse rib formed by said first end and hinge and carried by a pair of fingers laterally spaced apart commensurate with the width of the locking flap, the second end of the plate having a pair of hinged retention flaps releasably engageable with the locking flap when the plate is curved in a cylindrical configuration encircling the roll with the locking flap beneath the retention flaps and locking flap tabs at the non-hinged end of the locking flap to interfere with said retention flaps and prevent disengagement of the locking flap and retention flaps.

12. The cover as in claim 11 wherein the locking flap is slidable between the retention flaps to selectively change the diameter of its circular configuration.

13. The cover as in claim 11 wherein the bendable locking flap in the cylindrical configuration of the plate leaves an opening through which an end of the toilet paper roll may depend.

* * * * *